US006755628B1

(12) United States Patent
Howell

(10) Patent No.: US 6,755,628 B1
(45) Date of Patent: Jun. 29, 2004

(54) VALVE BODY FOR A TRAVELING BARREL PUMP

(75) Inventor: Kenneth Howell, Wynona, OK (US)

(73) Assignee: Howell's Well Service, Inc., Wynona, OK (US)

( * ) Notice: Subject to any disclaimer, the term of this patent is extended or adjusted under 35 U.S.C. 154(b) by 0 days.

(21) Appl. No.: 10/195,931

(22) Filed: Jul. 16, 2002

(51) Int. Cl.[7] ..... F04B 47/00; F04B 19/02; F04B 39/00; E21B 43/00

(52) U.S. Cl. ..... 417/448; 417/460; 417/453; 417/456; 417/459; 166/105

(58) Field of Search ..... 417/448, 460, 417/466, 468, 453, 456, 459, 554, 555.1, 567; 166/105, 109, 107

(56) References Cited

U.S. PATENT DOCUMENTS

| | | | | | |
|---|---|---|---|---|---|
| 271,082 | A | * | 1/1883 | Kimball | 417/554 |
| 1,545,474 | A | * | 7/1925 | Adams | 166/105.4 |
| 1,625,230 | A | * | 4/1927 | Thurston | 417/448 |
| 2,684,638 | A | * | 7/1954 | Sutton | 417/260 |
| 3,586,464 | A | | 6/1971 | Crowe | |
| 3,697,199 | A | | 10/1972 | Spears | 417/498 |
| 3,861,471 | A | | 1/1975 | Douglas | |
| 3,970,145 | A | * | 7/1976 | Boyd | 166/188 |
| 4,662,831 | A | | 5/1987 | Bennett | 417/430 |
| 4,907,953 | A | | 3/1990 | Hebert et al. | |
| 4,968,226 | A | | 11/1990 | Brewer | 417/435 |
| 5,009,000 | A | | 4/1991 | Wilmeth et al. | 29/888.02 |
| 5,012,871 | A | * | 5/1991 | Pleasants et al. | 166/386 |
| 5,141,416 | A | | 8/1992 | Cognevich et al. | 417/554 |
| 5,382,142 | A | | 1/1995 | Spears | |
| 5,533,876 | A | | 7/1996 | Nelson, II | |
| 5,593,289 | A | | 1/1997 | Tarpley | |
| 5,593,292 | A | | 1/1997 | Ivey | |
| 5,628,624 | A | | 5/1997 | Nelson, II | |
| 6,007,314 | A | | 12/1999 | Nelson, II | |
| 6,199,636 | B1 | | 3/2001 | Harrison | |

* cited by examiner

*Primary Examiner*—Justine R. Yu
*Assistant Examiner*—Timothy P. Solak
(74) *Attorney, Agent, or Firm*—Winstead Sechrest & Minick P.C.

(57) ABSTRACT

The invention is a component of a subsurface traveling barrel bottom anchor pump comprising a traveling valve assembly which includes: a cylindrical valve body having a lower section, the lower section having a central bore therethrough and external threads which interact with a threaded connection on a traveling barrel to removably attach the valve body to the traveling barrel; an upper section having a rod connection externally threaded for attachment to a pumping rod; a center section having a fishing neck portion and cage portion; a valve cage accommodated entirely within the internal portion of the cage portion; a valve ball positioned within the valve cage; a valve seat abutting the valve cage; and a ball and seat plug threaded into the lower section of the valve body for retaining the valve seat in the valve body.

1 Claim, 4 Drawing Sheets

VALVE BODY FOR A TRAVELING BARREL PUMP

REFERENCE TO PENDING APPLICATIONS

This application is not related to any pending applications.

REFERENCE TO MICROFICHE APPENDIX

This application is not referenced in any microfiche appendix.

1. Field of the Invention

This invention relates in general to subsurface pumps and, more particularly, to an improved pump for producing oil-bearing formations, which minimizes spacing between standing and traveling valve assemblies.

2. Description of Prior Art

A conventional oil well includes a cased well bore with one or more strings of tubing extending downwardly through the casing into the oil or other petroleum fluid contained in the subsurface mineral formation to be produced. The casing is perforated at the level of the production zone to permit fluid flow from the formation into the casing, and the lower end of the tubing string is generally open to provide entry for the fluid in the tubing.

There are basically two types of pumps typically associated with the production of oil bearing formations. Such pumps are defined as tubing pumps, rod pumps and each type of pump has its respective advantages and limitations.

With respect to tubing pumps, a tubing pump provides the largest displacement possible in any size of tubing, typically one quarter inch smaller than the nominal tubing inner diameter (I.D.). Where maximum displacement is needed, the tubing pump is the logical choice.

A tubing pump is the strongest pump made. The heavy wall barrel is connected directly to the bottom of the tubing string with a collar, eliminating the need for a seating assembly on the pump to hold the pump in position. Also, the sucker rod string connects directly to the plunger top cage, eliminating the need for the valve rod required in stationary barrel rod pumps. A disadvantage of the tubing pump is the fact that the tubing string must be pulled in order to replace the pump barrel. This increases the pulling unit time at the well.

The tubing pump is a poor installation in gassy fluid. Because of the length of the standing valve assembly and the puller on the plunger (and frequently the increased bore of an extension nipple) there is a large unswept area at the bottom of the stroke, causing a poor compression ratio. This reduces the effectiveness of the pump valving, and causes low pump efficiency in wells where gas enters the pump suction along with the produced fluid. The increased bore of a tubing pump causes increased load on the rod string and pumping unit. It also increases stroke loss due to rod and tubing stretch. As the pump is set deeper, this stroke loss may actually result in a lower net displacement than would be obtained with the smaller plunger of a rod pump. API RP11L calculations should be made on both the tubing pump and the rod pump to determine the optimum selection.

Rod pumps, however, have several distinguishable structures and each structure has its relative, respective advantage and disadvantage. Discussion now proceeds with respect to the relative merits and disadvantages of each rod pump type.

Stationary Barrel Bottom Anchor Pump

The stationary barrel bottom anchor pump is a pump consideration for deep wells. Like the traveling barrel pump, it has the advantage of having the hydrostatic tubing pressure applied to the outside of the barrel without the disadvantage of the column loading on the plunger bowing the pull tube on the downstroke. A stationary barrel bottom anchor pump is normally recommended for wells with low static fluid level, since the production tubing may be run in with only a short perforated nipple or mud anchor below the seating nipple. Thus, if required, the standing valve of the pump may be less than two feet from the bottom of the well.

The stationary barrel bottom anchor pump is superior to the traveling barrel bottom anchor pump for low fluid level wells as the fluid has only to pass the larger standing valve located immediately above the seating nipple in order to be pumped. The top anchor pump shares this advantage.

The stationary barrel bottom anchor pump is excellent for gassy wells when run in conjunction with a good oil-gas separator or gas anchor. The short rise required for the fluid to pass the standing valve and enter the pump minimizes the tendency to foam and thus reduce efficiency.

The stationary barrel bottom anchor pump is hazardous to run pump in a sandy well as sand can settle tightly in the annulus between the pump and the tubing and stick it tightly in the joint. This type of pump also has the disadvantage on intermittent operation that sand or other foreign material can settle past the barrel rod guide and on top of the pump plunger when the well is shut down, with the possibility of sticking the pump when it is put back on production.

Stationary Barrel Top Anchor Pump

The top anchor pump is recommended in sandy wells where a bottom anchor pump may become sanded in and cause a stripping job. The amount of sand that can settle over the seating ring or top cup is limited to a maximum of about three inches as the fluid discharge from the guide cage keeps it washed free above this point. In this respect, this pump type is superior to the stationary barrel bottom anchor pump as if a travel barrel pump is spaced too high, sand can settle around the pull tube right up to the lowest point reached by the pull plug on the downstroke.

The top anchor pump is specifically recommended in low fluid level gassy or foamy wells where it is particularly advantageous to have the standing valve submerged in the fluid being pumped. A gas anchor should run below the shoe on the tubing.

The outside of the pump barrel of a top anchor pump is at suction pressure, consequently it is more subject to burst or part the barrel tube than a bottom anchor pump. Well depth and the possibility of fluid pound should be carefully considered before running a top anchored pump with a thin wall barrel. If the depth of the well is within the depth recommendations, a top anchor pump is a good general purpose installation.

Irrespective of pump type (either rod or tube) certain criteria must be kept in mind to ensure optimum performance. Those considerations are classified under the subcategories of pump submergence, gas separation and installations where formation sand can be problematic. The energy to fill a pump during the upstroke must be supplied by the well formation. Therefore, it is essential the pump be installed as low in the well bore as possible to maintain minimum back pressure on the formation. The pump intake should be placed below the perforations or as close above them as possible.

Gas through the pump severely reduces pump efficiency. Where gas interference is a problem a properly designed gas separator should be installed as a part of the subsurface pumping assembly. Various styles are available with each having merits for a particular well condition. It is important to keep the back pressure on the gas at the wellhead at a minimum.

A pump will inherently have problems if sand is allowed to enter. Therefore, it is best to utilize some method of sand control to prevent entrance of sand into the well bore. Gravel packs, screens, and chemical bonding agents are frequently used for this purpose.

Traveling Barrel Bottom Anchor Pump

According to the contemporary art, the movement of the traveling barrel in this pump's structure keeps the fluid in motion and sand washed clear almost down to the seating nipple. This minimizes the possibility of sand settling around the pump and sticking it, causing a "wet" pulling job.

The traveling barrel bottom anchor pump is particularly recommended for wells that are pumped intermittently. Since the ball in the top cage will seat when the well is shut down, sand cannot settle inside of the pump. This is important, as it is possible for even a small quantity of sand settling on top of the plunger of a stationary barrel pump to cause the plunger to stick when the well again starts pumping.

In this pump structure, a sucker rod string connects directly to the top cage which in turn connects to the pump barrel. This top cage is greater in diameter and stronger in construction than a plunger top cage, so fluid load on the upstroke is carried by stronger components than in a stationary barrel pump.

Both the standing and traveling valves on a traveling barrel pump have open type cages. Such cages have more fluid passage than blind cages and are less prone to wear from ball action.

Due to equalized pressure on the outside of the barrel, a bottom anchored pump (either traveling or stationary barrel) has greater resistance to bursting than a top anchored pump. In wells that pound fluid, or in wells where top anchored pumps have experienced burst barrels, the traveling barrel pump is a good application.

The traveling barrel pump is at a disadvantage in wells that have a low static fluid level because of the greater pressure drop between the well bore and the pumping chamber. Since the standing valve is located in the plunger top cage on a traveling barrel pump, it is smaller in diameter and therefore uses a smaller ball and seat than would be used in the standing valve blind cage on a stationary barrel pump.

There is a relationship between pump length, well depth and pump bore which must be observed. When the standing valve (in the plunger top cage) is closed, a column load is transmitted by the plunger through the pull tube and seating assembly into the seating nipple. In a deep well, this load will be sufficient to put a bow in a long pull tube, thus setting up a drag between the pull plug and the pull tube.

It is to this pump structure the instant invention addresses its art enhancing valve placement(s) novelty. The instant invention can be conceptually viewed as a combination, upper barrel connector and cage with connection to a rod string indicated above a fishing neck. A ball and seat located in the bottom of the barrel connector positions ball seats of stationary and traveling valve assemblies closer together pumps of the contemporary art.

An extensive modification and testing, it has been shown that the instant invention practice facilitates traveling and stationary valve proximity approximately three inches distant from on another at the lowermost portion of the reciprocating pumps downward stroke. Thus allowing for enhanced efficiency and far less (adverse) potential for gas lock. The minimizing of such adverse potential is attributed to increased compression realized via closer proximity positioning the positioning of the afore noted valves. The unique structure of the instant invention deserves the longevity of a standard, open cage as in open cages of the contemporary art wear out far more frequently than their associated valve connector due to the lack of material in the walls after machining.

The invention further provides a product that will have a fishing neck in the event that the rod pin should break. Absent the teachings of the instant invention, when a standard, open top cage breaks the only way to retrieve the pump is by pulling the pump tubing.

Various arrangements of pumps have been suggested in the prior art to overcome problems associated with sucker rod pumps for oil wells. U.S. Pat. No. 5,141,416 to Cognevich et al describes a method of manufacturing a plunger for a downhole reciprocating oil well pump. A cylindrical material plunger has its outer surface machined and then is prepared by grit-blasting to receive a coating of ceramic and then the ceramic outer surface is ground to the proper plunger design diameter. Cognevich et al is providing a surface that is longer wearing than the original material surface of the plunger.

U.S. Pat. No. 5,009,000 to Wilmeth et al describes a method of hardening the plunger by forming a boronized case on the plunger. The plunger additionally includes circumferential grooves which tend to trap abrasive particles and help equalize hydrostatic pressure around the plunger.

U.S. Pat. No. 4,968,226 to Brewer describes a plurality of openings formed in the midportion of the pump barrel. These openings allow fluid from the tubing string to enter the intake chamber of the barrel during a portion of the upstroke permitting equilibration of the pressure differential therebetween. Further Brewer provides a traveling valve with a substantially reduced outside diameter which permits fluid around the outside diameter traveling valve cage which permits fluid around its outer surface between the pump barrel and the traveling valve cage. A plunger, sized for substantially fluid tight reciprocation relative to the barrel, is received in the barrel. The plunger has a top with an opening therein and a bottom with an opening therein, and a body. The body defines a cavity continuous with the openings in the top and bottom of the plunger. The length of the plunger is substantially less then the length of the barrel. The plunger has an end portion which, with a portion of the barrel cavity, defines a fluid intake chamber. The volume of the fluid intake chamber therefore varies with reciprocal movement of the plunger and the barrel. A valve associated with the plunger is included for permitting fluid to flow through the plunger only in an upward direction. The openings in the midportion of the barrel cooperate with the relative lengths of the barrel and the plunger to prevent fluid communication between the conduit and the fluid intake chamber during a first phase of the extension stroke and to permit communication between the conduit and the fluid intake chamber during a second phase of the extension stroke.

U.S. Pat. No. 4,662,831 to Bennett discloses a pump for lifting liquids from a well in an earth formation and concurrently fracturing the earth formation. This is accomplished using a pump of the reciprocating piston variety and providing a first valve that permits a quantity of the liquid to be gathered on the downstroke of the pump and lifted during the upstroke of the pump and a second valve that permits a portion of the formation liquids to be forced back in to the earth formation during a first portion of the downstroke of the pump and that prevents further passage of fluids back in to the formation during a second portion of the downstroke of the pump. Also, a third valve for venting formation gases from the interior of the pump near the top of the pump upstroke in order to prevent cushioning of the force of the pump downstroke due to the compressibility of such gases.

U.S. Pat. No. 3,697,199 to Spears discloses a slave valve pump. The pump employs a first piston which is directly moved by an external power source and a slave piston which is moved by the resulting pressure differentials created by the movement of the first piston. The first or lower piston is fixed to the lower end of a cylindrical rod and the upper piston has a tubular form and is adapted to slide over the rod. The axial movement of the upper piston is controlled by the resulting pressure differential crested across its length. The pressure differential acts to move the upper piston to appropriately open or close the outlet ports of the pump which in turn permits fluid to be expelled through the outlet ports and prevents return flow into the pump. On the downstroke of the lower piston, a reduced pressure is created between the slave piston and the lower piston which permits fluid flow into this low pressure area between the two pistons which the lower piston moves past inlet ports and fluid is forced through the inlet ports to the low pressure area.

U.S. Patent No. 5,593,289 relates to an improvement in plunger valve assemblies for reciprocating sucker rod operated subsurface pumps and specifically as to the traveling valves and standing valves. The traveling valve includes a valve body having an inwardly-directed lip at the bottom with the valve seat, ball and cage inserted from the top of the valve body. Further the standing valve has a closed cage formed in the upper portion thereof which is threaded into the bottom of the pump barrel, thus placing the closed cage of the standing valve and the traveling valve in closer proximity at the bottom of the downstroke than prior such pumps.

Though purporting to disclose similar benefits to those offered by the instant invention, the '289 patent is limited to those pumping structures which rely upon a stationary (non-moving) barrel.

The instant invention addresses itself to the traveling barrel structures of reciprocating pumps and, indeed, incorporates itself therein. The teachings of the '289 patent which are clearly distinguishable from the instant invention as they rely upon redesigning the barrel cage of a stationary valve body, as well as the plunger cage for traveling barrel body in a manner to reduce the space between the valve and the traveling valve when the pump is at the end of the downstroke. The singular, independent claim of the '289 patent and its disclosure teach away from the benefits of the moving barrel pump assembly afforded by the instant invention.

Consequently, it is a object of the instant invention to provide a pumping structure which minimizes spacing between traveling and stationary valve assemblies to avoid or minimize potential of gas lock during pumping operations.

SUMMARY OF THE INVENTION

The invention provides an improved reciprocating pump for production of fluids from oil and gas wells. The improvement lies in redesigning a traveling barrel cage or traveling valve body in a manner to reduce the space between a stationary valve located generally toward the bottom of a pumping string and the traveling valve such that when the pump is at the end of the downstroke traveling and stationary valves are in closer proximity than can be afforded via pumping technology of the contemporary art.

In view of the limitations and disadvantages of the afore cited prior art, it is apparent that what is needed is a subsurface rod pump with a traveling barrel assembly which effectuates closer proximity valve traveling and stationary valve positions in an effort to reduce or eliminate gas locking during pumping operations. A need unrecognized or ignored by the contemporary art and exceeded by the instant invention.

DESCRIPTION OF THE DRAWINGS

The invention will be better understood by an examination of the following description, together with the accompanying drawings, in which.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled. Various modifications, which will come readily to the mind of one skilled in the art, are within the scope of the invention as defined in the appended claims.

Figure 1:
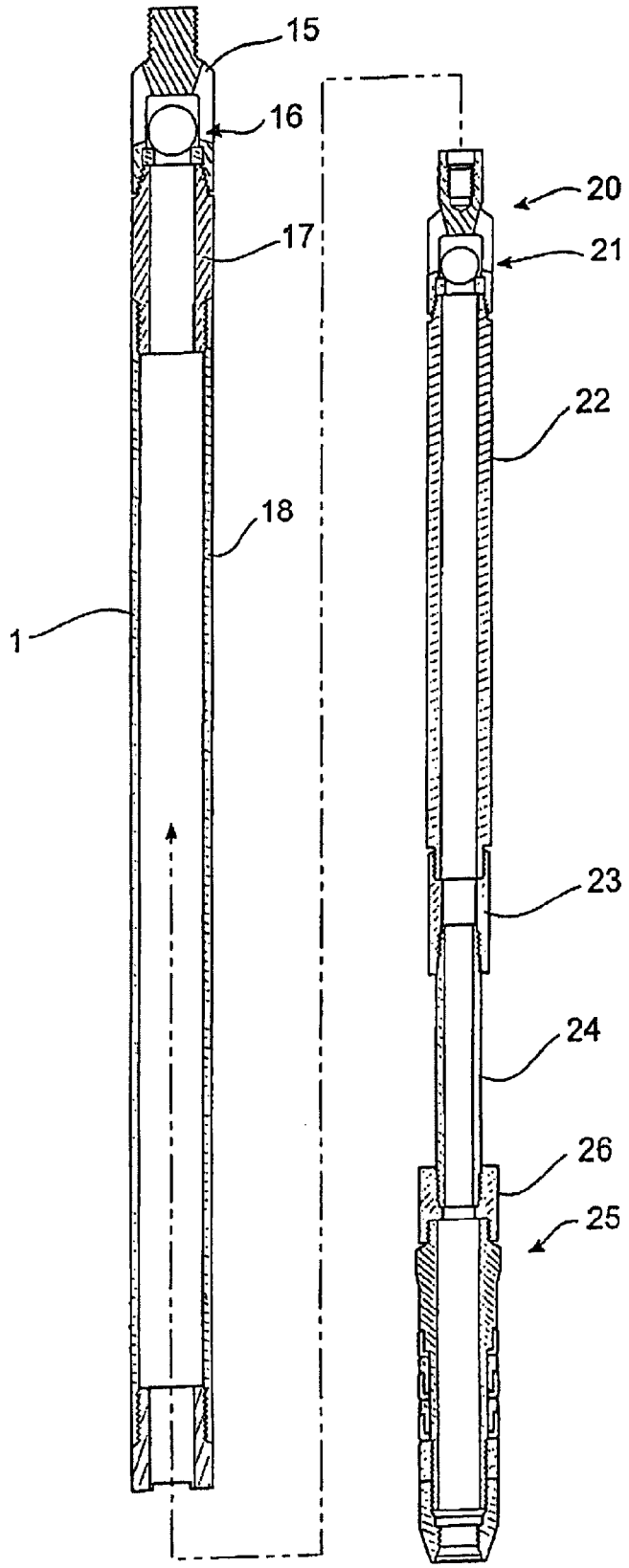
FIG. 1 PRIOR ART
FIG. 1 is a prior art illustration of a traveling barrel bottom anchor pump as practiced in the contemporary art.
Figure 2:
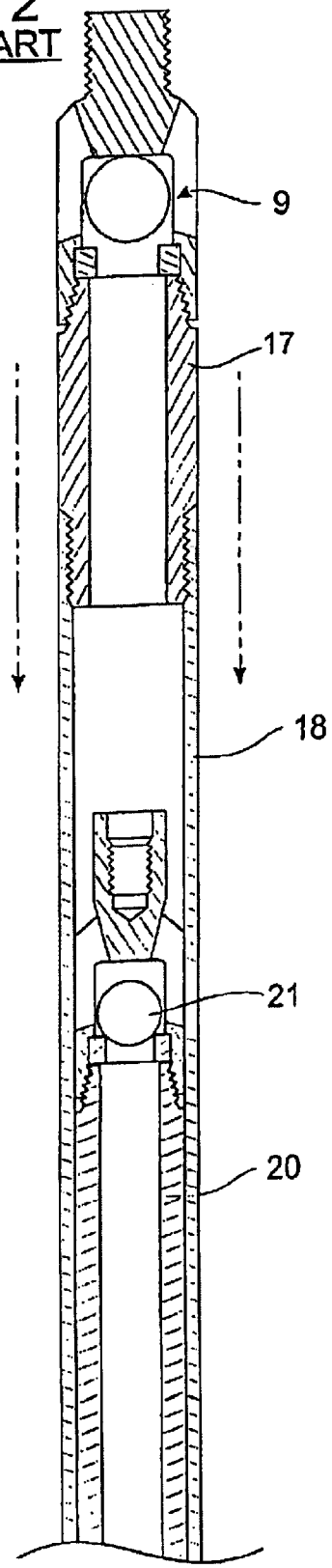
FIG. 2 PRIOR ART
FIG. 2 is a prior art illustration of a traveling barrel bottom anchor pump of FIG. 1 providing closer detail of the pump's valve assemblies during the pump's downstroke.
Figure 2A:
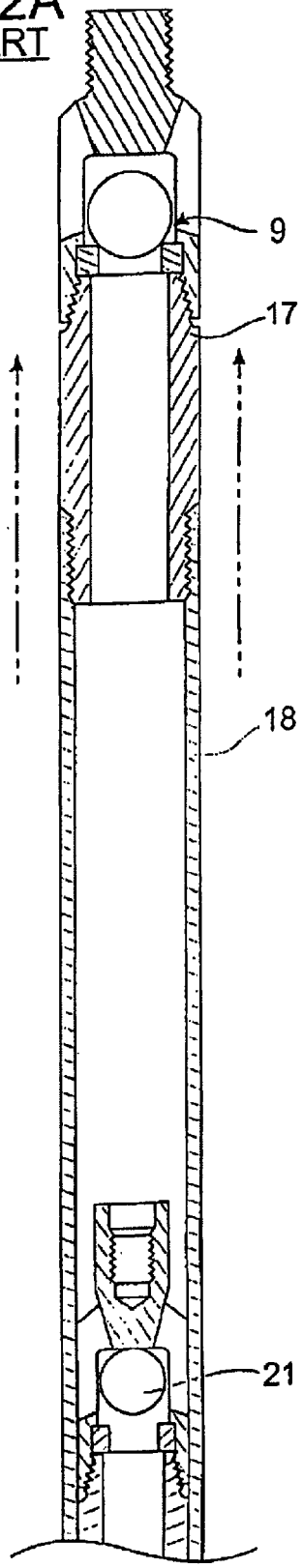
FIG. 2A PRIOR ART
FIG.2*a* is a prior art illustration of a traveling barrel bottom anchor pump of FIG. 1 providing close detail of the pump's valve assemblies during the pump's upstroke.

To facilitate ease of understanding with respect to the teachings, benefits and claims of the instant invention, it is best to first review the structure of contemporary traveling barrel bottom anchor pumps, such discussion is provided in association with FIGS. 1 through 2*a*. Detailed description of the structure of the instant invention is provided in association with FIGS. 3

FIG. 1 is a prior art illustration of a traveling barrel bottom anchor pump as practiced in the contemporary art is shown wherein a traveling barrel assembly 1 is illustrated along side its corresponding plunger assembly 20 with dashed lines indicating insertion of plunger assembly 20 within the barrel assembly 1 for pumping operation.

Continuing with FIG. 1, where the traveling barrel assembly 1 comprises an open top cage 15, a traveling valve assembly ball and seat 16, a barrel connector 17 which couples said valve assembly 16 to the traveling barrel 18. As distinguished from the instant invention, the contemporary art patents two points of potential failure exist with respect to using barrel connector 17 to threadably connect the traveling valve assembly 16 and the barrel 18. Only one such threaded connection is necessary to effectuate the practice instant invention.

FIG. 1 further illustrates additional detail with respect to the bottom anchor plunger assembly 20 used in conjunction with traveling barrel bottom anchor pumps of the contemporary art wherein there is also disclosed an open plunger cage 25, a plunger 22, a valve assembly comprised of a ball and seat 21, an upper plunger coupling 23 which threadably engages and connects said plunger 22 with a pull tube 24, and a lower coupler 26 which threadably engages pull tube 24 with a seating assembly 25.

Prior art FIGS. 2 and 2*a* further disclose an illustration of the traveling barrel bottom anchor pump in closer detail associated with traveling barrel bottom anchor pumps of the contemporary art during the pump's downstroke 18 and an illustration of the traveling barrel bottom anchor pump in closer detail associated with traveling barrel bottom anchor pumps of the contemporary art during the pump's upstroke 18 respectively.

Turning now to FIG. 2, FIG. 2 illustrates a downstroke operation of the prior art. FIG. 2, it can be determined that the plunger assembly 20 of the prior art remains stationary and internal traveling valve assembly 9 comprised of a ball and seat threadably attached to a moving (traveling) barrel 18 travels downwardly toward a stationary valve assembly 21 threadably attached to an anchored plunger 22. In so doing, the traveling valve assembly 9 is restricted from achieving any closer proximity to the standing valve assembly 21 than that allowed as a consequence of its (prior art) positioning above top barrel connector 17.

In traveling barrel bottom anchor pumping structures of the contemporary art both standing and traveling valves typically operate in open cages as open cage structures provide less restriction when moving or pumping heavy fluids. In operation, pressure is equalized in traveling barrel bottom anchor pumps and this form of pump has a greater resistance to bursting to a top anchor pump more particularly when using a heavy walled barrel. However, the traveling barrel bottom anchor pump of the contemporary art realizes gas lock far more frequently than the stationary barrel type pumps as the standing valve is smaller in such installations than the traveling valve.

FIG. 2*a* illustrates an illustration of the traveling barrel bottom anchor pump in closer detail associated with traveling barrel bottom anchor pumps of the contemporary art during the pump's upstroke.

In FIG. 2*a*, the contemporary art is illustrated during an upstroke of the traveling barrel bottom anchor pumping operation wherein it may also be observed where the stationary valve assembly 21 is open to allow passage therethrough of extracted fluids and the traveling valve assembly 21 remains closed.

Figure 3:
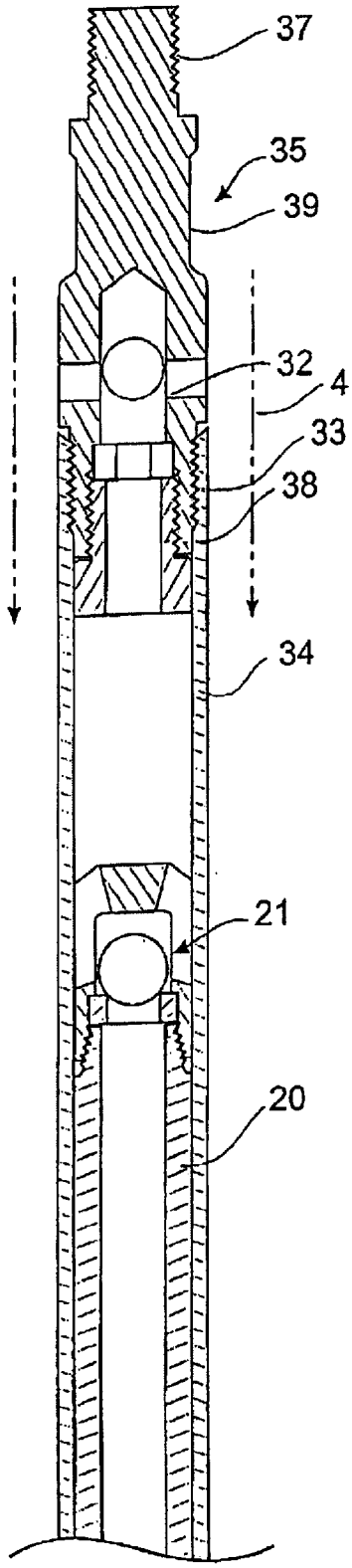
FIG. 3 is an illustration of the instant invention's traveling barrel bottom anchor pump in providing detail associated with the pump's valve assemblies during the pump's downstroke.
Figure 3A:
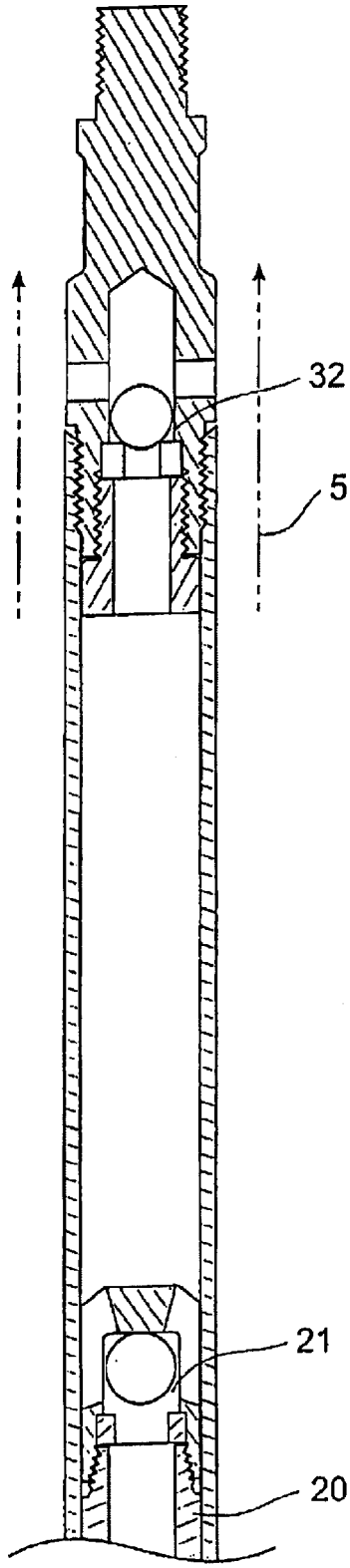
FIG. 3*a* is an illustration of the instant invention's traveling barrel bottom anchor pump in providing detail associated with the pump's valve assemblies of the instant invention during the pump's upstroke.

Distinguishing its structure and from the prior art, FIGS. 3 and 3*a* show respectively illustrate the instant invention in one preferred embodiment during its downstroke operation (FIG. 3) and upstroke operation in FIG. 3a. In FIG. 3, the instant invention's downstroke operation is indicated by arrows 4. The valve assembly is comprised of a ball and seat and is embodied as a necessary and essential component of a barrel assembly 35 structure wherein a single threaded interconnection 33 exists to threadably connect said assembly to the barrel structure 34. Also, illustrated is a seat plug 38 to hold the valve assembly 32 in place, rod pin connection 37 to connect the barrel assembly 35 to a pumping rod (not illustrated) and the fishing neck 39 of the instant invention.

FIG. 3*a* illustrates the traveling barrel bottom anchor pump of the instant invention in closer detail associated the pump's upstroke. The practice of the present invention in FIG. 3*a* is shown wherein the fixed plunger 20 stationary valve 21 is allowed to open to pull or withdraw liquid from a reservoir and the traveling valve assembly 32 of the instant invention remains closed to trap said pumped liquid until its next downstroke, whereupon said valve assembly 32 will open and allow fluid to be passed through the traveling valve located and integrated within the valve traveling barrel pump assembly 35 of the instant invention as indicated in FIG. 3.

Figure 4:
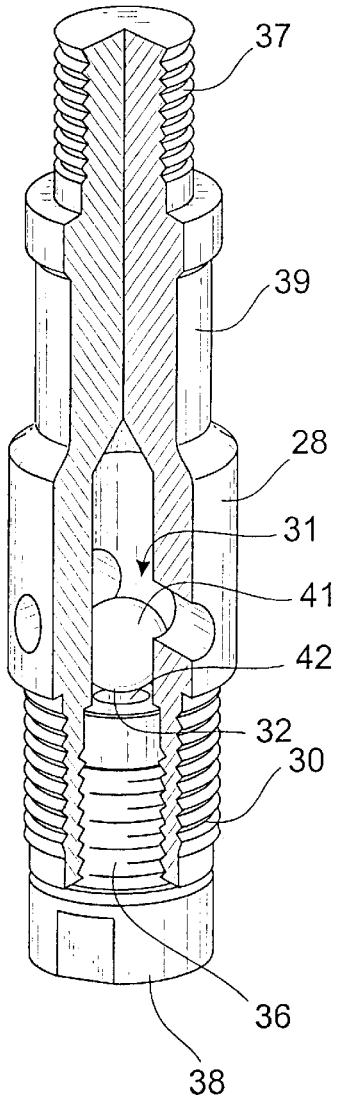
FIG. 4 is an assembled, fragmented view illustrating the traveling valve assembly of the instant invention providing greater specificity of detail with respect to valve assembly components.
Figure 5:
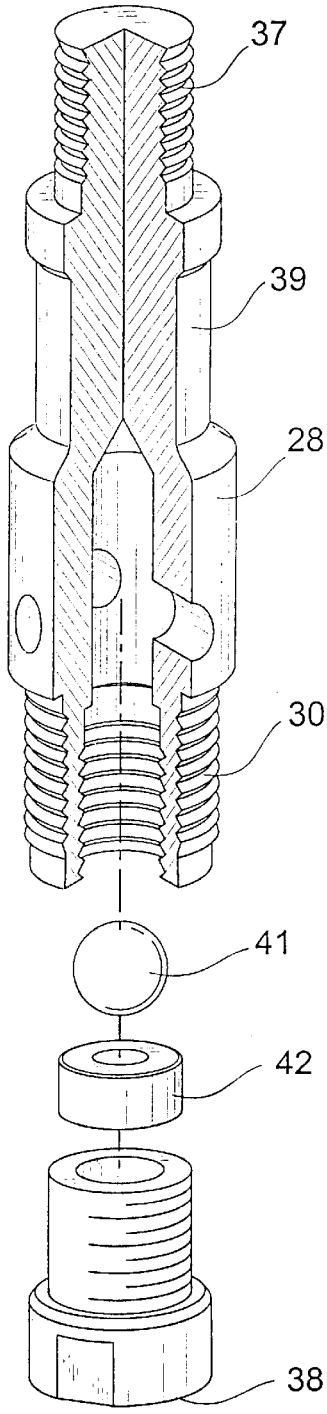
FIG. 5 is an exploded, fragmented view of the valve assembly of the instant invention providing greater specificity of detail with respect to valve assembly components.
Figure 6:
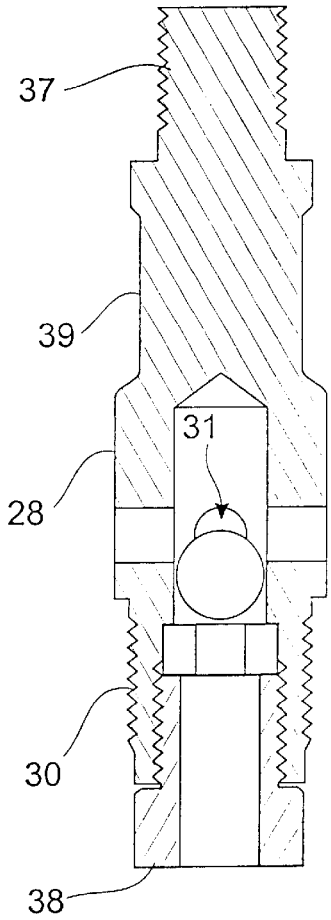
FIG. 6 is a cross-sectional view of the valve assembly illustrated in FIGS. 4 and 5 providing greater specificity of detail with respect to valve assembly components.

FIGS. 4, 5 and 6 illustrate further detail with respect to the valve assembly of the instant invention.

Turning now to discussion of FIGS. 4, 5, and 6, it is shown where connector 37 is a threadable attachment means for connecting to a pumping rod (not illustrated) connection and is located immediately above the fishing neck 39 of the invention's valve body.

The invention valve assembly 28 is clearly represented as a cylindrical valve body having a lower section with the lower section having a central bore 36 extended therethrough and external threads 30 to interact with a threadable connection on a traveling barrel to removably attach said valve assembly 28 to said traveling barrel and an upper section having a reduced diameter rod connection 37 for connection to a pumping rod, in addition to a center section having a reduced diameter fishing neck 39 portion and large diameter cage portion 31. The cage portion 3 1 of the instant invention has accommodated entirely within its internal construct a valve ball 41 positioned within the cage 31 and a valve seat 42 abutting the cage.

Further disclosed in association with FIGS. 4, 5, and 6, is a ball and seat plug 38 which is threaded into the lower section of the valve body for retaining the valve seat 42 in the valve body.

FIG. 4 is an assembled, fragmented view illustrating the traveling valve assembly of the instant invention providing greater detail with respect to valve assembly components.

FIG. 5 is an exploded, fragmented view of the valve assembly of the instant invention providing further detail with respect to valve assembly components.

FIG. 6 is a cross-sectional view of the valve assembly illustrated in FIGS. 4 and 5 providing additional detail with respect to valve assembly components.

Also it will be appreciated that the close proximity between the standing valve and the traveling valve at the bottom of the downstroke is such that either the pump itself may be shorter for the same stroke of the barrel or the stroke of the barrel may be increased by the decrease in distance between the traveling valve and the standing valve on the downstroke.

Alternate Embodiments

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. In a subsurface traveling barrel, bottom anchor pump for pumping fluid from an oil and gas reservoir, the improvement comprising a traveling valve assembly which includes:

a cylindrical valve body having a lower section, said lower section having a central bore therethrough and external threads which interact with a threaded connection on a traveling barrel to removably attach said valve body to said traveling barrel and adjacent internal threads; an upper section having a rod connection externally threaded for attachment to a pumping rod, a center section having a fishing neck portion and a cage portion;

a valve cage accommodated entirely within the internal portion of said cage portion;

a valve ball positioned within said valve cage;

a valve seat abutting said valve care; and a ball and seat plug threaded into said internal threads of the lower section of said valve body for retaining said valve seat in said valve.

* * * * *

UNITED STATES PATENT AND TRADEMARK OFFICE

CERTIFICATE OF CORRECTION

PATENT NO. : 6,755,628 B1
DATED : June 29, 2004
INVENTOR(S) : Kenneth Howell

It is certified that error appears in the above-identified patent and that said Letters Patent is hereby corrected as shown below:

Column 10,
Line 22, add -- body -- after the words “in said valve”.

Signed and Sealed this

Fourteenth Day of September, 2004

JON W. DUDAS
*Director of the United States Patent and Trademark Office*